US011035644B2

(12) United States Patent
Moretti

(10) Patent No.: US 11,035,644 B2
(45) Date of Patent: Jun. 15, 2021

(54) GUN STOCK

(71) Applicant: BENELLI ARMI S.p.A, Urbino (IT)

(72) Inventor: Luigi Moretti, Collebeato (IT)

(73) Assignee: BENELLI ARMI S.P.A., Urbino (IT)

( * ) Notice: Subject to any disclaimer, the term of this patent is extended or adjusted under 35 U.S.C. 154(b) by 0 days.

(21) Appl. No.: 16/891,185

(22) Filed: Jun. 3, 2020

(65) Prior Publication Data

US 2020/0386510 A1 Dec. 10, 2020

(30) Foreign Application Priority Data

Jun. 4, 2019 (IT) ..... 102019000007998

(51) Int. Cl.
*F41C 23/14* (2006.01)

(52) U.S. Cl.
CPC ..... *F41C 23/14* (2013.01)

(58) Field of Classification Search
CPC ..... F41C 23/14
USPC ..... 42/73
See application file for complete search history.

(56) References Cited

U.S. PATENT DOCUMENTS 179,075 A * 6/1876 Smith ..... F41C 23/14 42/73
243,553 A * 6/1881 Hape et al. ..... F41C 23/14 42/73
1,480,350 A * 1/1924 Martin ..... F41C 23/14 42/74
1,869,086 A * 7/1932 Ash ..... F41C 23/14 42/73
2,187,548 A * 1/1940 Smith ..... F41C 23/14 42/73
2,631,398 A * 3/1953 Fantoni ..... F41C 23/14 42/73
5,001,855 A * 3/1991 Griggs ..... F41C 23/08 42/74
7,748,154 B2 * 7/2010 Moretti ..... F41C 23/14 42/75.03
8,776,423 B2 * 7/2014 Paquette ..... F41C 23/14 42/73
10,907,931 B2 * 2/2021 Schoenborn ..... F41C 23/14
2016/0018184 A1 * 1/2016 Park ..... F41C 23/20 42/73
2020/0149840 A1 * 5/2020 Schoenborn ..... F41C 23/14

* cited by examiner

*Primary Examiner* — Samir Abdosh
(74) *Attorney, Agent, or Firm* — Duane Morris LLP; Gregory M. Lefkowitz

(57) ABSTRACT

A gun stock has a hollow body having a cavity in which a seat is formed; the seat is adapted to receive an insert; the insert has a passage hole for the passage of a bar which has a first end fastened to the body of the gun and a second free end which is threaded and engages a locking nut; a fastener plate is arranged between the locking nut and the insert and has a calibrated hole through which the free end of the bar passes; the fastener plate is arrangeable in different positions with respect to the insert in order to change the inclination of the stock with respect to the line of sight of the gun. The stock has additional systems for adjusting the distance between the buttstock and the trigger, the height of the comb, the length of the trigger pull, and the shape of the grip.

15 Claims, 12 Drawing Sheets

GUN STOCK

The present invention relates to a gun stock, particularly for long firearms, such as rifles and carbines.

The stock is a part of the firearm body that is extended so that it can rest against the shoulder so that the energy of the recoil is absorbed.

The stock can be shaped variously so as to make it particularly ergonomic and also suitable for the physical measurements of the individual shooter.

Various systems are known for mounting the stock so as to be able to adjust various parameters thereof in order to adapt it to the specific requirements of the shooter.

Adjustment systems of the known type can be complicated both from the production standpoint and from the point of view of the user.

U.S. Pat. Nos. 2,631,398, 179,075 and 243,553 disclose adjustable gunstocks.

The aim of the present invention is to provide a new stock, particularly for long firearm, that offers different possibilities of adjustment and is constructively simple and has a low cost.

Within the scope of this aim, an object of the invention is to provide a stock that has an integrated mechanism for adjusting the drop and/or cast of the stock.

Another object of the invention is to provide a stock that has a significantly lower industrial production cost than the systems used up to now to obtain comparable results.

A further object of the invention is to provide a stock that has an integrated system for adjusting the distance between the buttstock and the trigger.

A further object of the invention is to provide a stock that has an integrated system for adjusting the height of the comb.

A further object of the invention is to provide a stock that has an integrated system for adjusting the length of the pull of the trigger, i.e., the distance between the grip and the trigger.

A further object of the invention is to provide a stock that has an integrated system for adjusting the shape of the grip.

A further object of the present invention is to provide a structure which, by virtue of its particular constructive characteristics, is capable of giving the greatest assurances of reliability and safety in use.

This aim, these objects and others which will become better apparent hereinafter are achieved by a gun stock comprising a hollow body which comprises at least one cavity; a seat formed in said cavity and adapted to receive an insert; said insert comprising a passage hole for the passage of a bar; said bar having a first end and a second end; said first end being fastened to the body of said gun; said free end being threaded and engaging a locking nut; said stock further comprising a fastener plate arranged between said locking nut and said insert; said fastener plate having a calibrated hole; said free end of said bar passing through said calibrated hole; said fastener plate being arrangeable in different positions with respect to said insert in order to change the inclination of said stock with respect to the line of sight of the gun.

Further characteristics and advantages will become better apparent from the description of preferred but not exclusive embodiments of the invention, illustrated by way of non-limiting example in the accompanying drawings, wherein.

Figure 1:
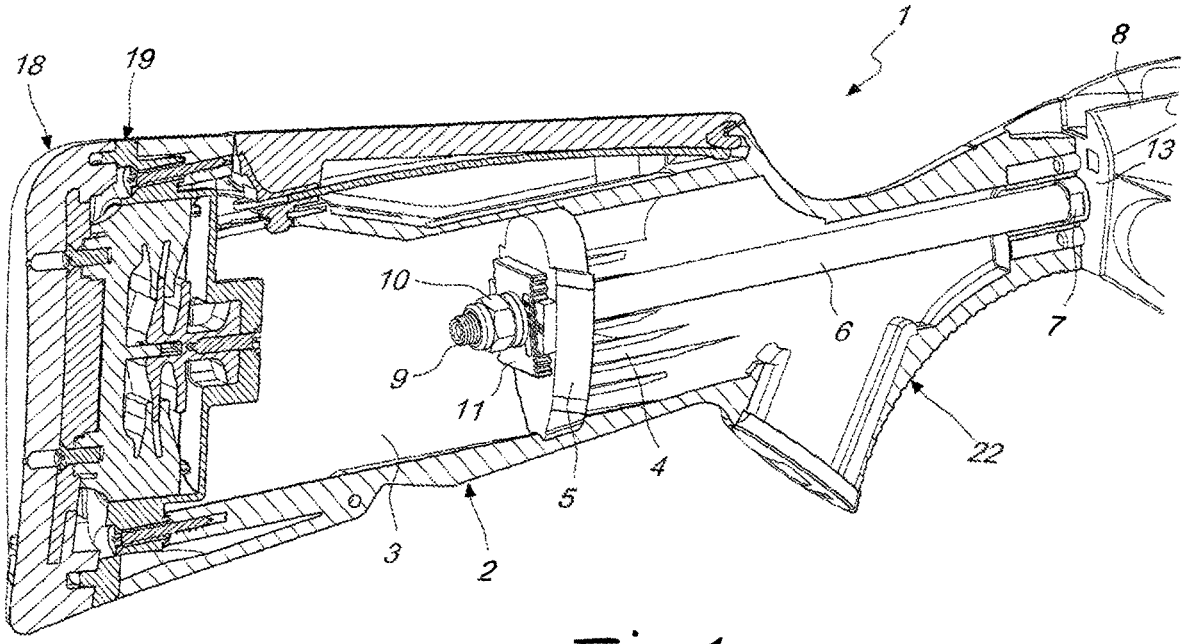
FIG. 1 is a longitudinally sectional perspective view of the stock according to the invention, in an embodiment made of polymeric material.
Figure 2:
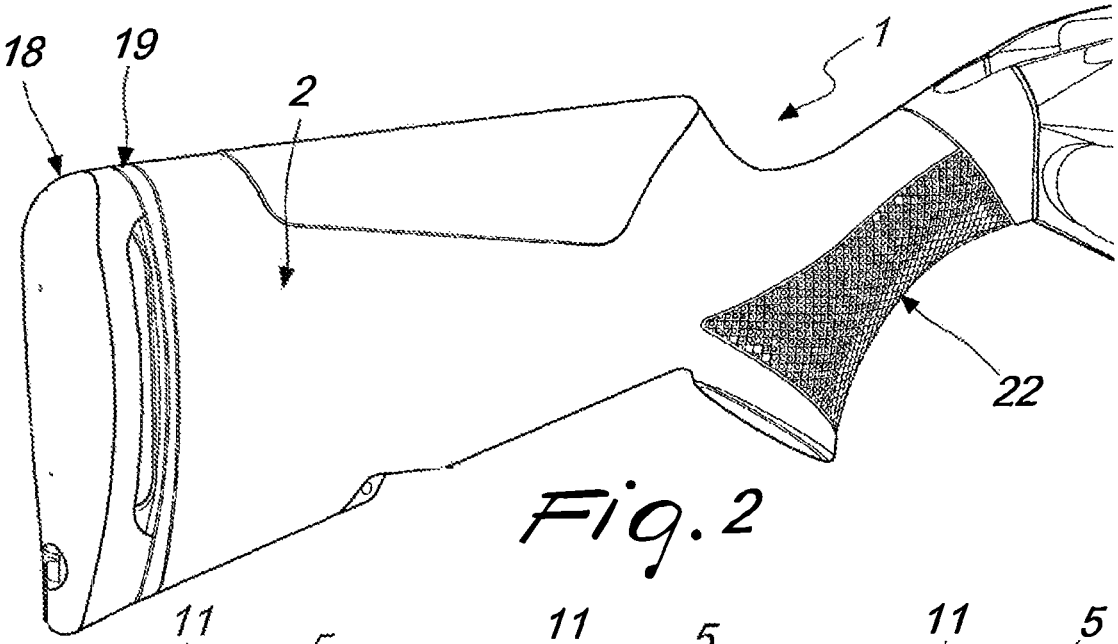
FIG. 2 is a perspective view of the stock of the preceding figure.
Figure 3:
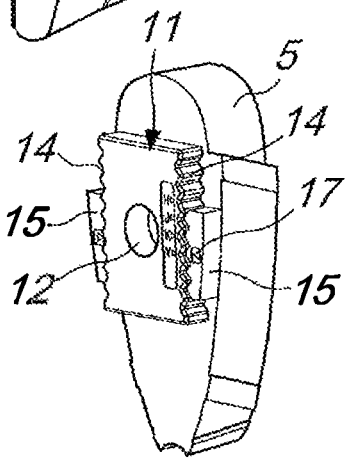
FIGS. 3-5 are perspective views of the locking insert and of the front plate of the stock of the preceding figure, shown in different positions of adjustment of the drop of the stock.

With reference to the cited figures, the stock according to the invention, designated generally by the reference numeral 1, has a hollow body 2 which has at least one cavity 3.

A seat 4 is formed in the cavity 3 and is adapted to receive an insert 5.

The insert 5 has a hole for the passage of a bar 6, which has a first end 7 and a second free end 9.

The first end 7 is fastened to the frame 8 of the firearm by threading.

The free end 9 is threaded and engages a locking nut 10.

The stock 1 is fastened to the frame 8 of the firearm by tensioning the nut 10 and the tightening torque allows to lock the stock in a sandwich-like manner between the insert 5 and a front plate 13.

According to the present invention, a fastener plate 11 is inserted between the nut 10 and the insert 5 and has a calibrated hole 12 for the passage of the free end 9 of the bar 6.

The fastener plate is provided in two embodiments: a fastener plate 11, in which the calibrated hole 12 is in a central position, and a fastener plate 111, in which the calibrated hole 112 is in an axially offset position.

Figure 7:
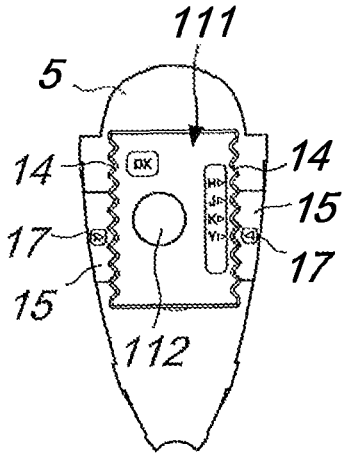
Figure 8:
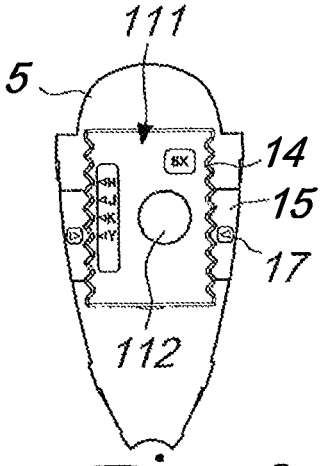
Figure 9:
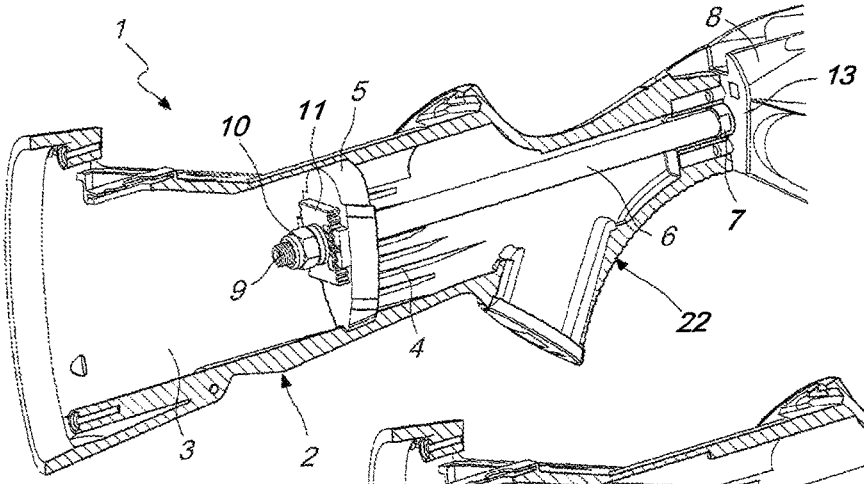
FIG. 9 is a longitudinally sectional perspective view of the stock, in an embodiment made of polymeric material, shown without the buttstock and the buttstock support.

The plate 111 with the axially offset hole 112 can be seen in FIGS. 7 and 8.

The passage hole of the insert 5 is wide enough to allow a displacement of the free end 9 within the hole.

The fastener plate 11, 111 has side teeth 14 which engage a pair of toothed abutments 15, 115 which are formed on the insert 5, 105, allowing to arrange the fastener plate 11, 111 in positions at different heights with respect to the insert 5, 105.

Figure 31:
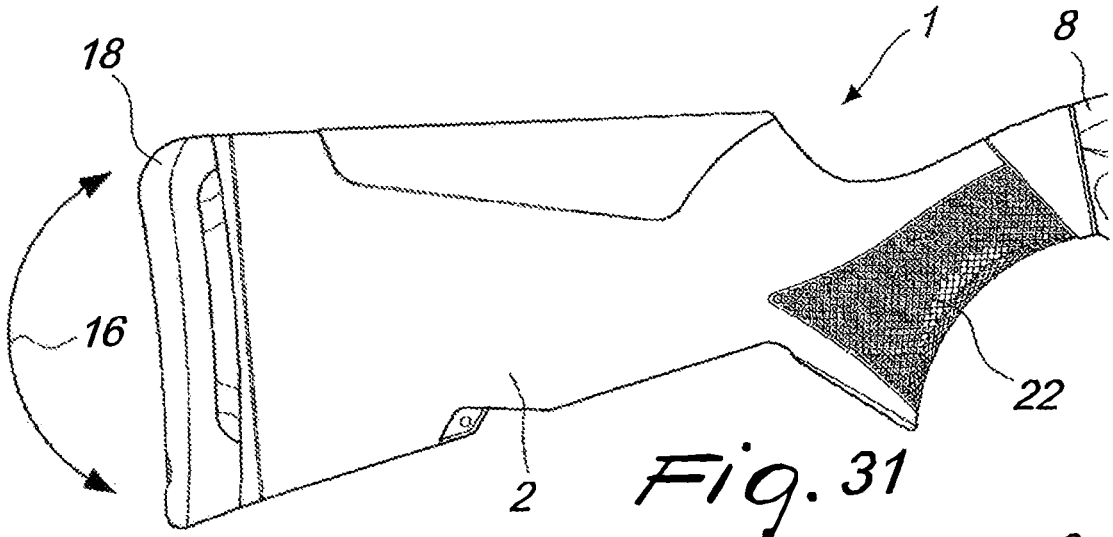
FIG. 31 is a side view of the stock.

The structure described above allows to adjust the drop of the stock 1, 101 with respect to the firearm, i.e., the vertical inclination of the stock with respect to the line of sight, as shown schematically by the double arrow 16 in FIG. 31.

According to the present invention, the toothed profiles of the insert 5, 105 and of the fastener plate 11, 111 allow to make the stock 1, 101 assume different drops by arranging the fastener plate in different positions, in terms of height, with respect to the insert.

Advantageously, the fastener plate 11 is symmetrical to avoid inappropriate assemblies.

The insert 5 can be a single one both for wood stocks and for polymer stocks, or can be dedicated to the specific stock type.

FIGS. 1-10 show an embodiment of a stock made of polymeric material, designated by the reference numeral 1, while FIGS. 11-15 show an embodiment of a wood stock, designated by the reference numeral 101.

In the embodiment shown in FIGS. 11-15, the insert 105 is shaped adequately with respect to the seat 104 of the cavity 103 of the hollow body 102 of the wood stock 101.

In FIGS. 11-15, the reference numerals that are identical to the reference numerals used in FIGS. 1-10 identify similar components.

The front plate 13, interposed between the stock 1, 101 and the rest of the firearm, is preferably compatible with the set drop.

FIGS. 3, 6, 7, 8 and 13 show the position of the fastener plate 11, 111 that corresponds to a drop of the stock that is close to the maximum one.

Figure 4:
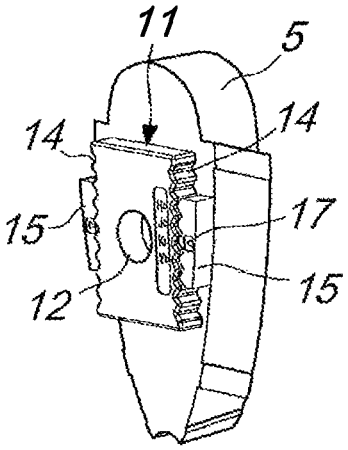
Figure 14:
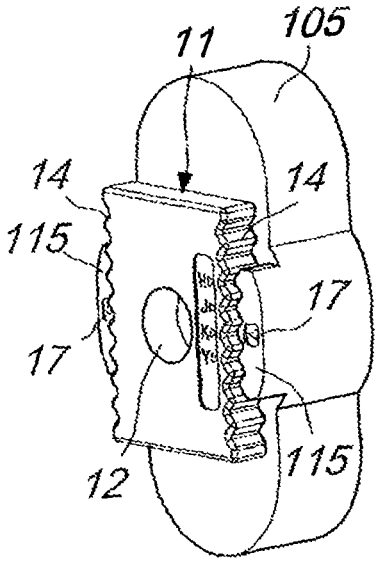

FIGS. 4 and 14 show the position of the fastener plate 11 that corresponds to a medium drop.

Figure 5:
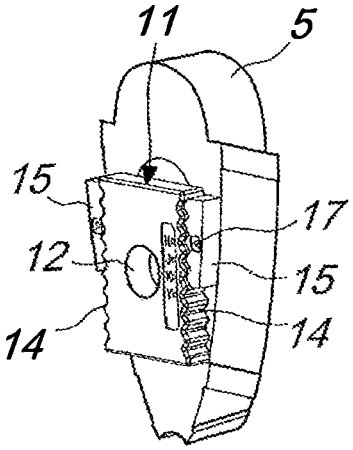
Figure 6:
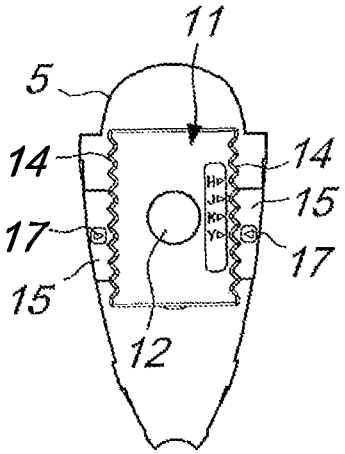
FIGS. 6-8 are front views of the locking insert and of the front plate, shown in different positions of adjustment of the cast of the stock.
Figure 15:
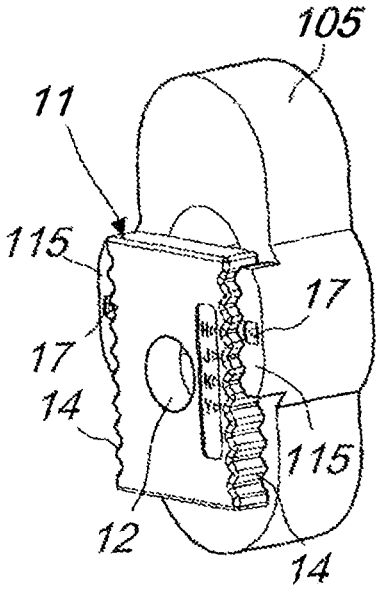

FIGS. 5 and 15 show the position of the fastener plate 11 that corresponds to a minimum drop of the stock.

This type of adjustment is discrete and predefined: the number and the pitch of the vertical teeth determines the number of drops and their amount.

In order to facilitate the setting of the drop, indicator symbols are provided on the plate 11, 111 and allow to align the plate with respect to an indicator 17 engraved on the abutments 15, 115 of the insert 5, 105.

In the embodiments shown in the figures, the letters H, J, K, Y constitute the indicator symbols on the plate 11, 111 which identify respective drops of the stock.

The system according to the present invention also allows to adjust the cast, or offset, of the stock, which is the inclination on the horizontal plane, i.e., to the left or right, of the stock with respect to the line of sight.

In order to vary the cast of the stock, the fastener plate 111 is used, in which the calibrated hole 112 is in an axially offset position, i.e., horizontally off-center, which can be seen in FIGS. 7 and 8.

With the plate 11, provided with a central calibrated hole 12, visible in FIGS. 3, 4, 5, 6, 13, 14 and 15, it is possible to vary exclusively the drop of the stock, i.e., the vertical inclination.

With the plate 111, provided with an axially offset calibrated hole 112, visible in FIGS. 7 and 8, it is possible to vary the drop and cast of the stock, i.e., both the vertical inclination and the horizontal inclination.

By using the two fastener plates 11 and 111 it is therefore possible to have three casts: none (FIGS. 3, 4, 5, 6, 13, 14, 15), to the right (FIG. 7) and to the left (FIG. 8).

The right or left cast of the stock is obtained by mounting the plate 111 in positions that are reversed horizontally with respect to each other.

The fixing and adjustment system has been conceived to be the same both for polymer stocks and for wood stocks.

The core of the adjustment system is constituted by the combination of the insert 5, 105 and of the fastener plate 11, 111, which are preassembled, with the desired drop and/or cast, outside the stock and are then inserted in it.

Preferably, the front plate 13 interposed between the stock 1, 101 and the rest of the firearm must be compatible with the set drop.

Figure 10:
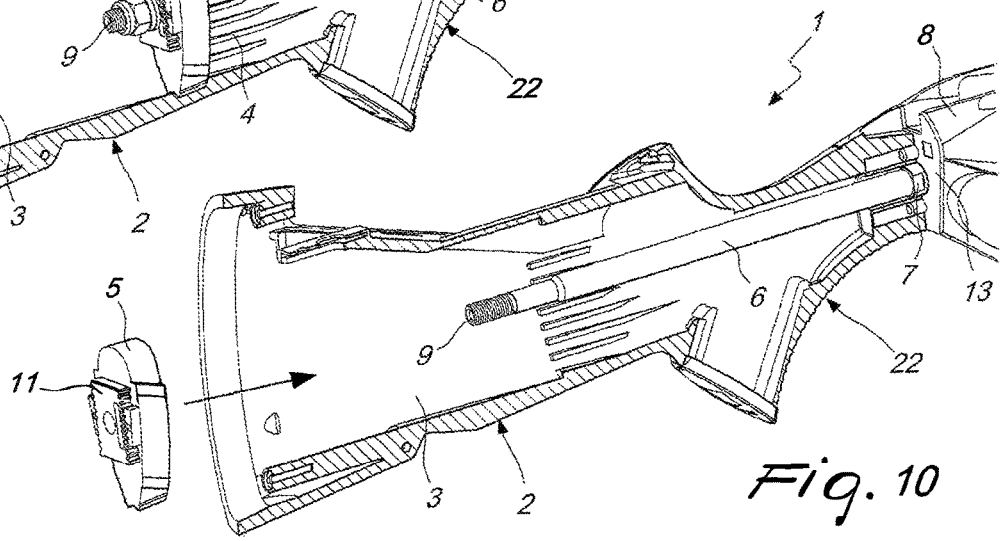
FIG. 10 is a view, similar to the preceding one, where the insert and the plate are extracted from the stock.
Figure 11:
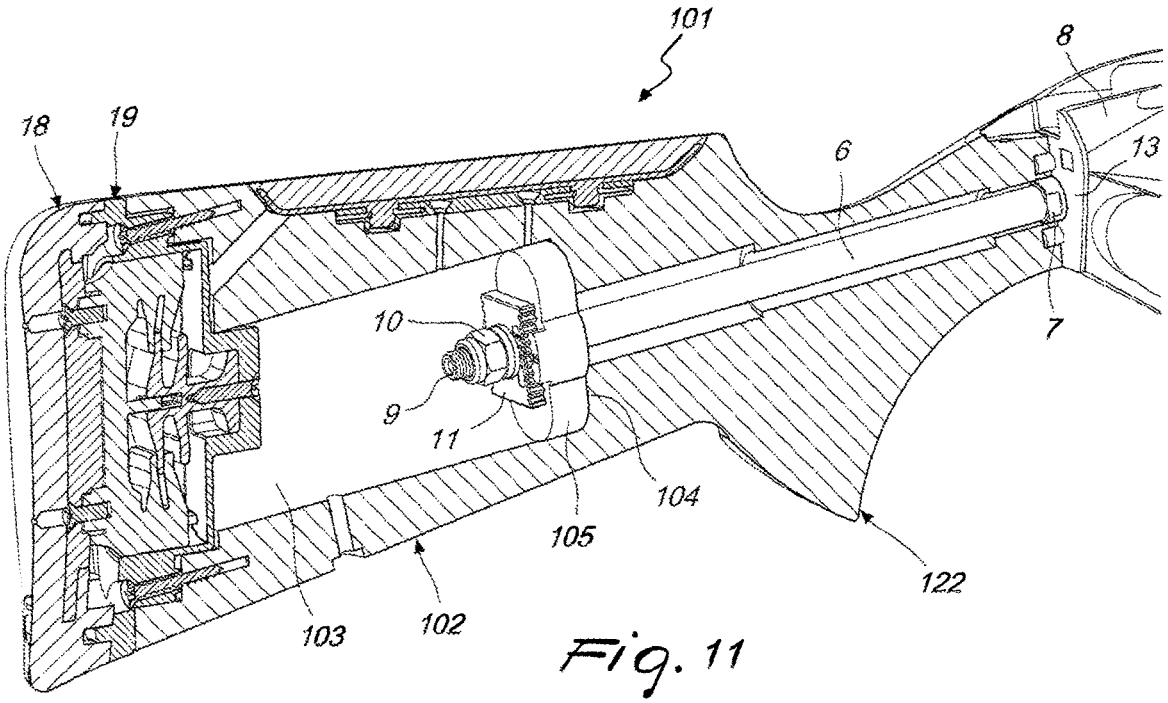
FIG. 11 is a longitudinally sectional perspective view of the stock according to the invention, in the embodiment made of wood.
Figure 12:
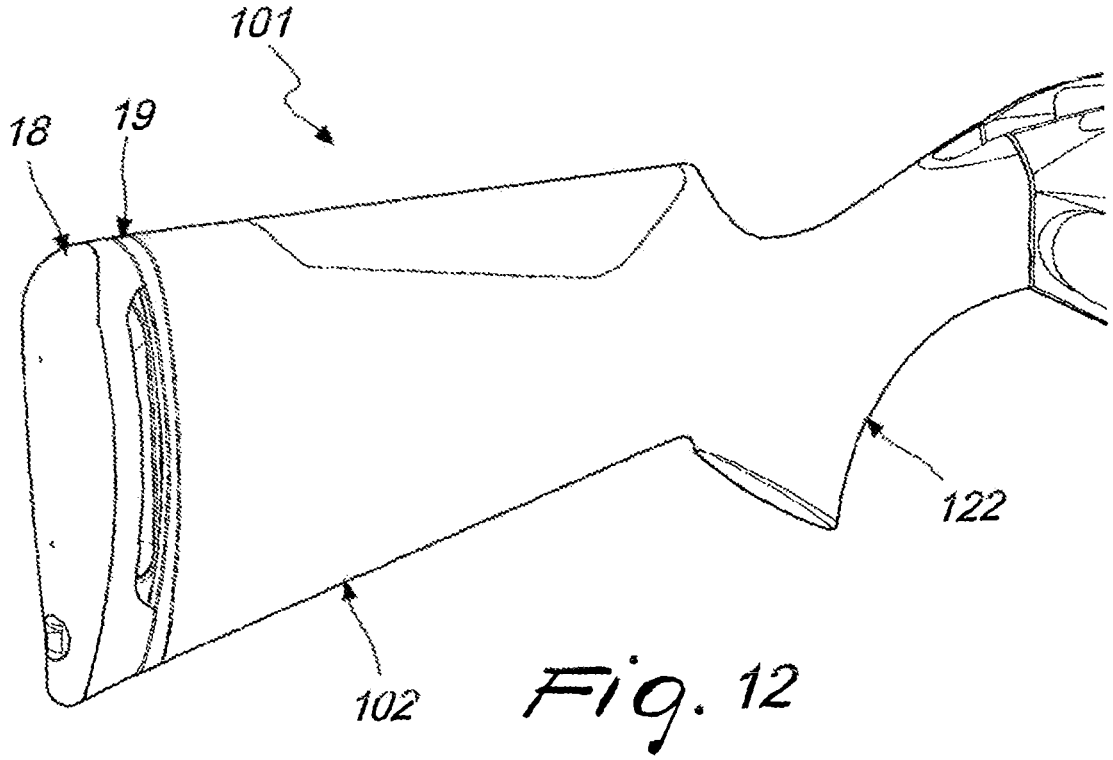
FIG. 12 is a perspective view of the stock of the preceding figure.
Figure 13:
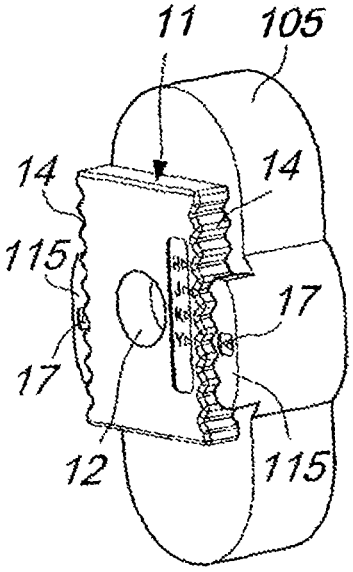
FIGS. 13-15 are perspective views of the locking insert and of the front plate of the stock of the preceding figure, shown in different adjustment positions.

FIG. 10 shows schematically the step of assembly of the insert-fastener plate assembly inside the stock.

A way of increasing the number of cast positions of the stock, is that of adopting the toothed system described above to vary the drop, providing the fastener plate and the corresponding insert with the teeth arranged horizontally instead of vertically.

Another system for increasing the number of cast positions of the stock is to provide multiple plates 111 with the calibrated hole 112 axially offset in different positions.

Figure 32:
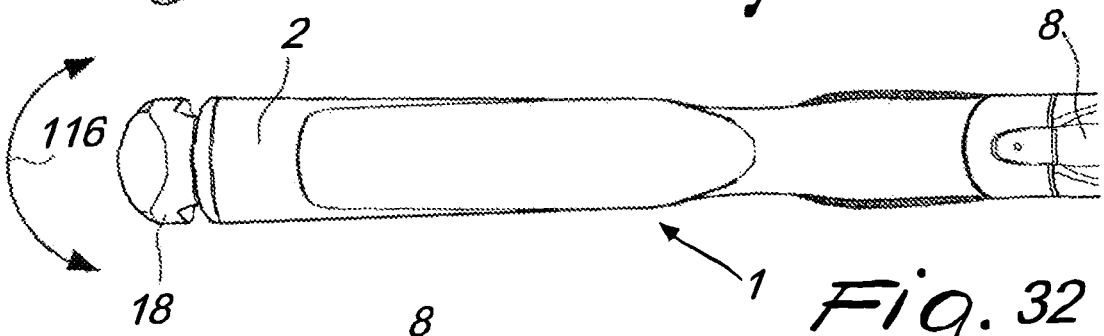
FIG. 32 is a plan view of the stock.
Figure 33:
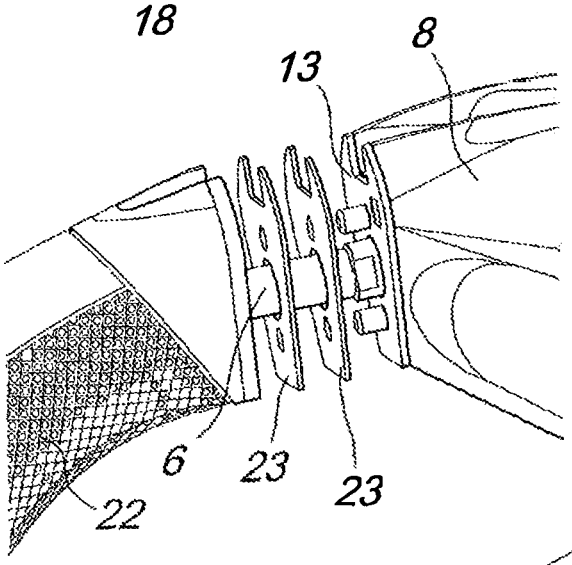
FIGS. 33-34 are perspective views of the region for coupling the stock to the frame, which show different combinations of adjustments of the pull of the trigger.
Figure 34:
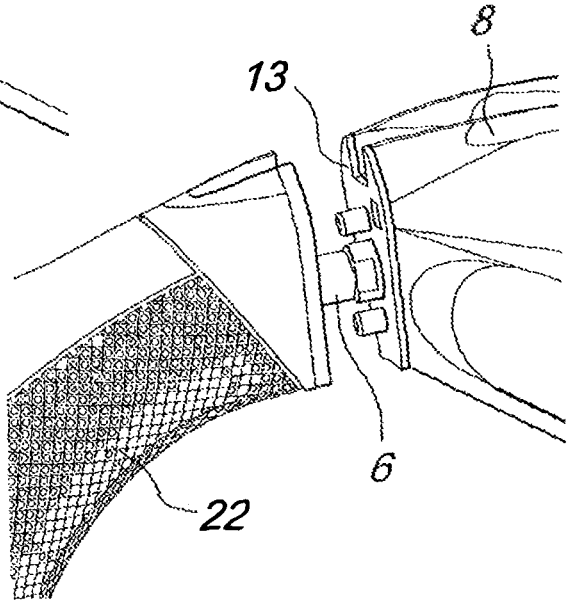
Figure 35:
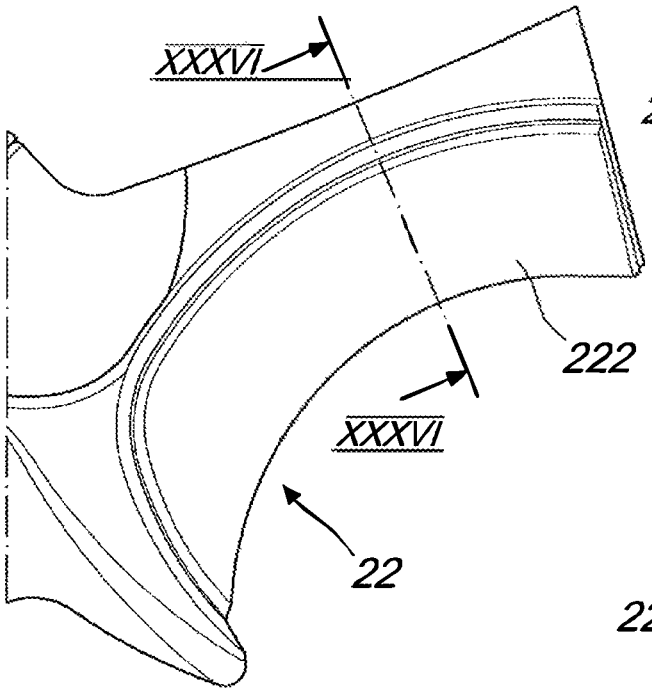
FIG. 35 is a side view of the stock without the grip.
Figure 36:
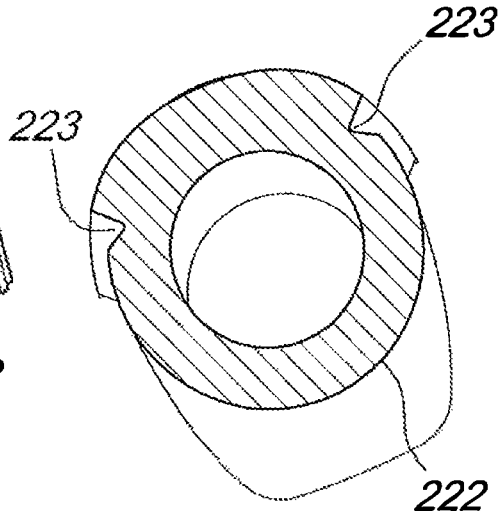
FIG. 36 is a sectional view, taken along the sectional plane XXXVI-XXXVI of the preceding figure.
Figure 37:
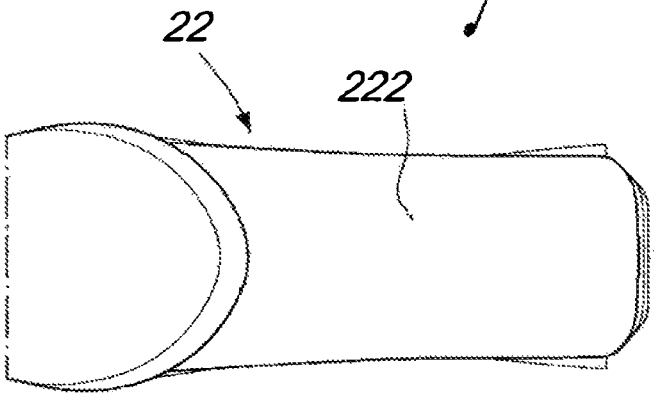
FIG. 37 is a bottom view of the stock without the grip.
Figure 38:
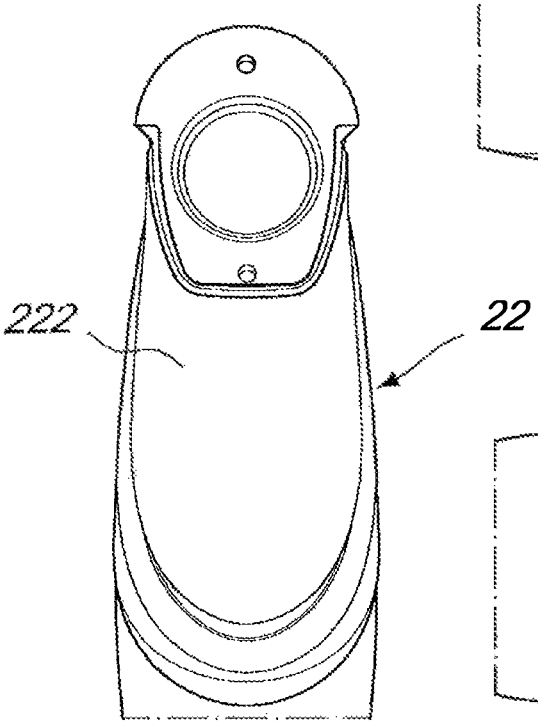
FIG. 38 is a front view of the stock without the grip.
Figure 39:
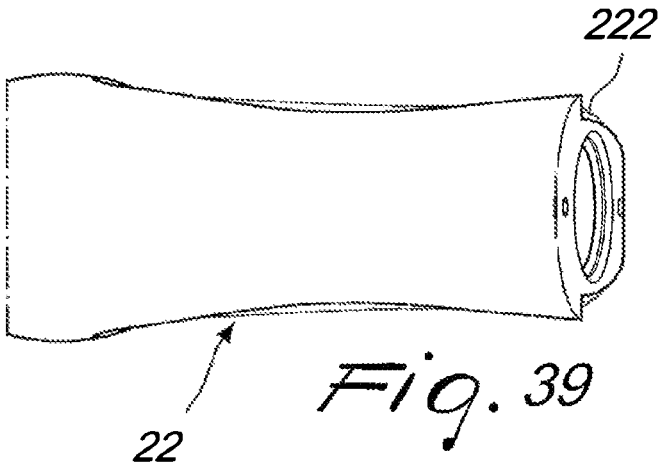
FIG. 39 is a top view of the stock without the grip.
Figure 40:
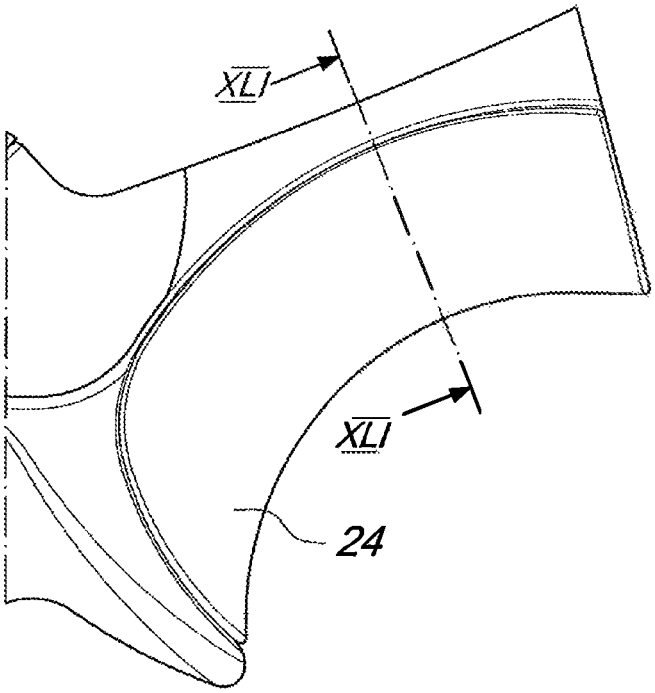
FIG. 40 is a side view of the stock with the grip assembled.
Figure 41:
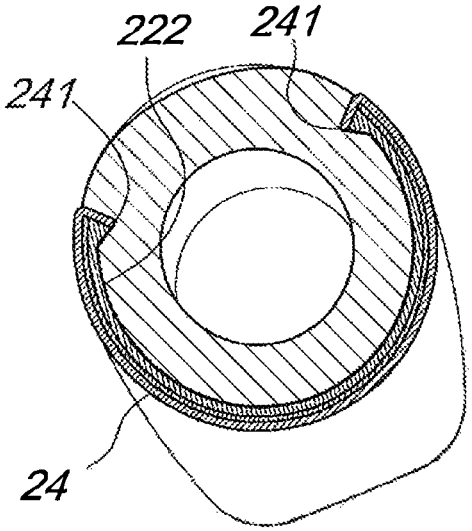
FIG. 41 is a sectional view, taken along the sectional plane XLI-XLI of the preceding figure.
Figure 42:
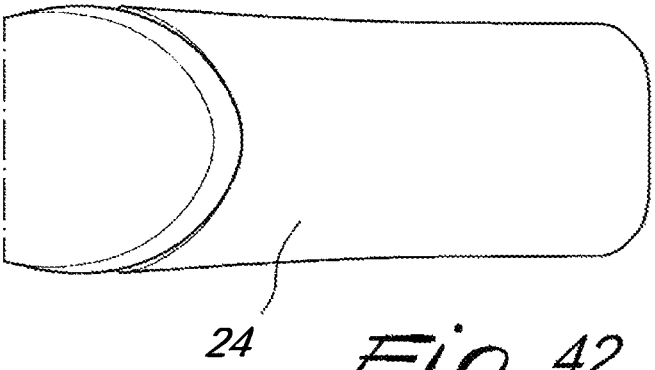
FIG. 42 is a bottom view of the stock, with the grip assembled.
Figure 43:
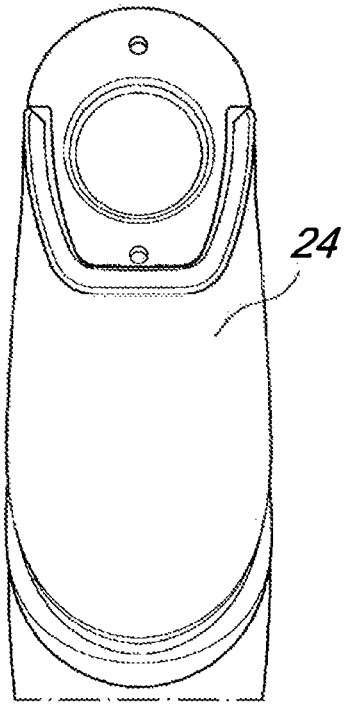
FIG. 43 is a front view of the stock, with the grip assembled.
Figure 44:
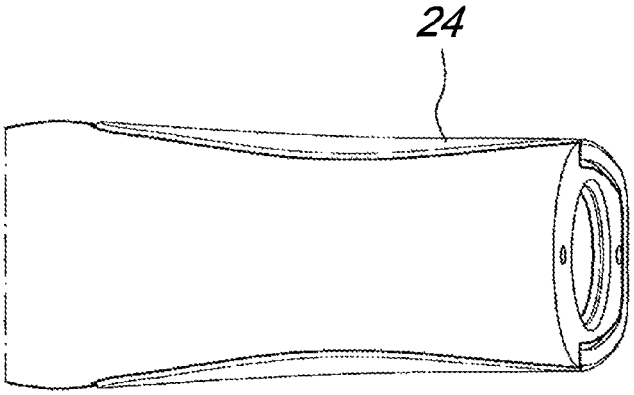
FIG. 44 is a top view of the stock, with the grip assembled.
Figure 45:
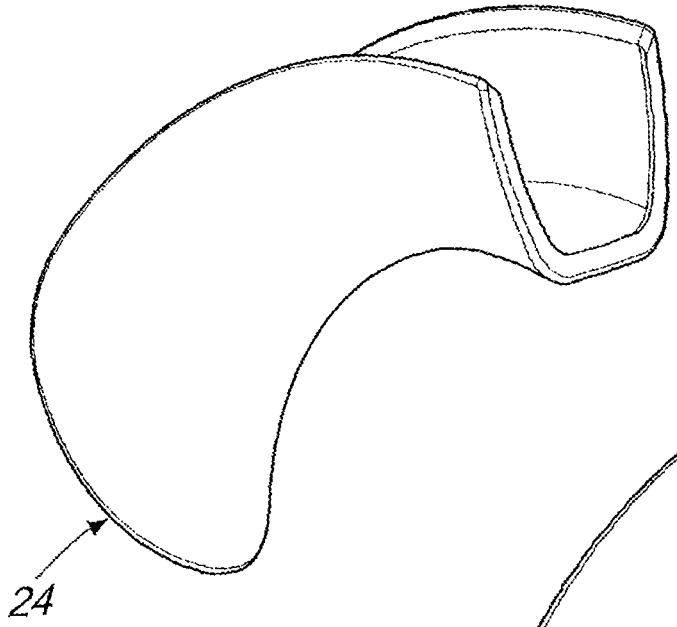
FIG. 45 is a perspective view of the grip.
Figure 46:
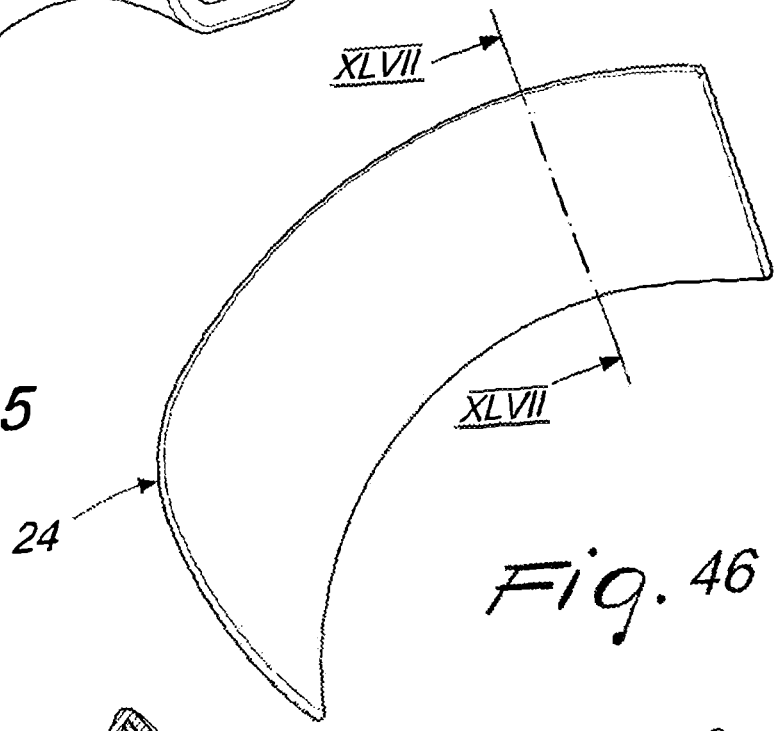
FIG. 46 is a side view of the grip.
Figure 47:
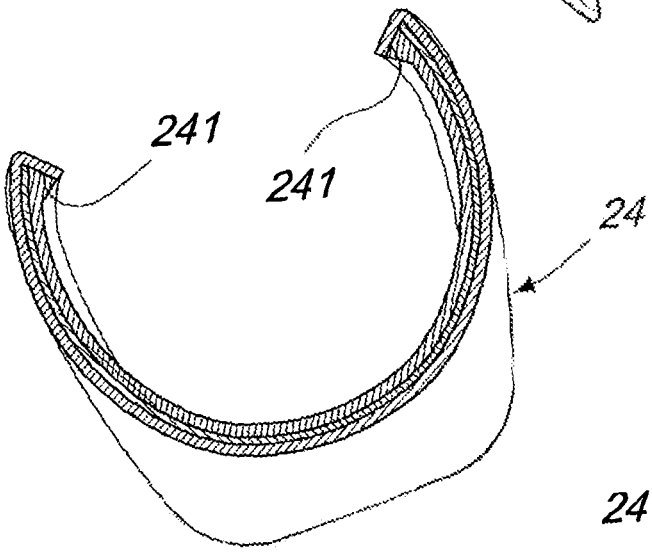
FIG. 47 is a sectional view, taken along the sectional plane XLVII-XLVII of the preceding figure.
Figure 48:
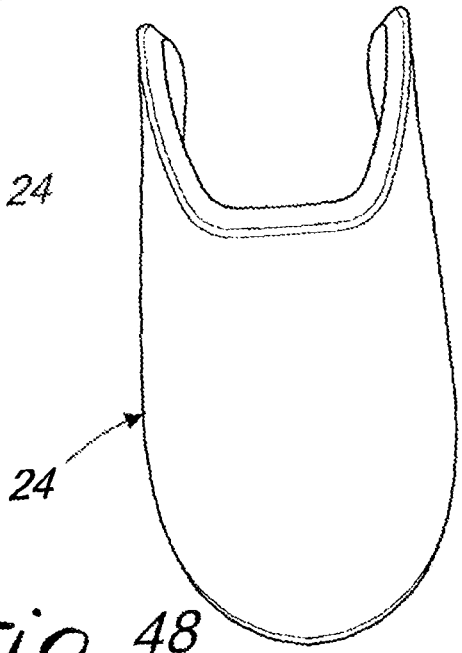
FIG. 48 is a front view of the grip.

The structure described above allows to adjust the cast of the stock 1, 101 with respect to the firearm, i.e., the inclination on the horizontal plane of the stock 1, 101 with respect to the line of sight, as indicated schematically by the double arrow 116 in FIG. 32.

The stock according to the present invention also provides for a system for adjusting the distance between the buttstock and the trigger, the so-called LOP (length of pull).

The system for adjusting the distance between the buttstock and the trigger has a buttstock 18, 118 that has a variable thickness and/or a buttstock support 19 that has a variable thickness.

Advantageously, the buttstock support 19 is constituted by a recoil reducer device of the type described in patent EP2711660B1, which has a boxlike body 20 in which a damping means is inserted which have a fixed part and a movable part; the fixed part is integral with the boxlike body and the movable part can slide in an axial direction inside the boxlike body; the buttstock 18, 118 is integral with the movable part.

According to the present invention, the buttstock is provided in various thicknesses. FIGS. 16, 17, 18, 20, 22 and 24 show a buttstock 18 of reduced thickness; FIGS. 21, 23 and 25 show a buttstock 118 with an increased thickness.

The variation of the thickness of the buttstock support 19 is provided by means of a pair of spacers, respectively a fixed spacer 191 and a movable spacer 192.

The fixed spacer 191 is integral with the fixed part of the support, i.e., with the boxlike body, while the movable spacer 192 is integral with the movable part of the support.

The user can choose whether to use only the buttstock or whether to use both (buttstock and spacer).

Figure 20:
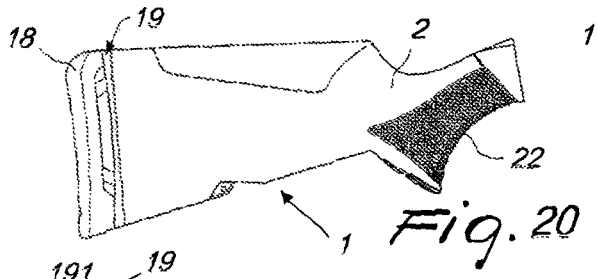
FIG. 20 is a side view of the stock provided with a standard buttstock.
Figure 21:
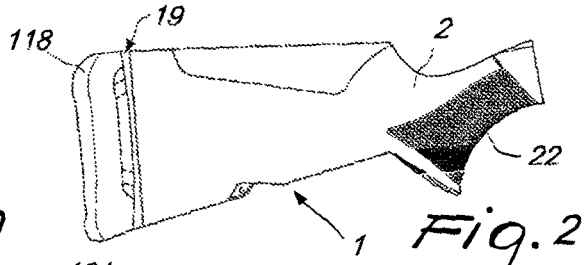
FIG. 21 is a side view of the stock provided with a high buttstock.

FIG. 20 shows the use of a standard buttstock 18, while FIG. 21 shows the use of an enlarged or high buttstock 118.

Figure 22:
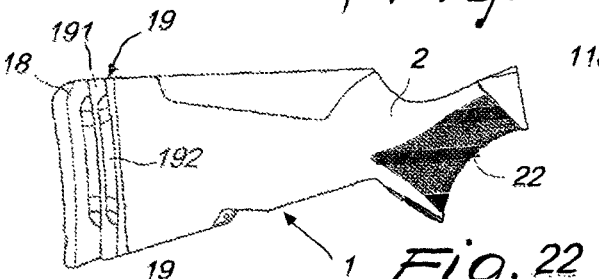
FIG. 22 is a side view of the stock provided with a standard buttstock with a pair of spacers.
Figure 23:
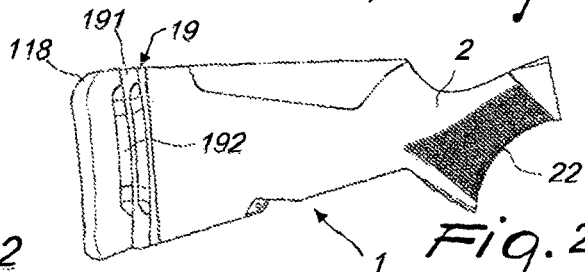
FIG. 23 is a side view of the stock provided with a high buttstock with a pair of spacers.

FIG. 22 shows the use of a standard buttstock 18 with a pair of spacers 191, 192, while FIG. 23 shows the use of an enlarged or high buttstock 118 with a pair of spacers 191, 192.

Figure 24:
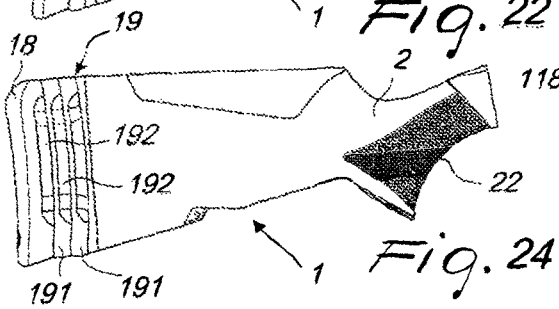
FIG. 24 is a side view of the stock provided with a standard buttstock with two pairs of spacers.
Figure 25:
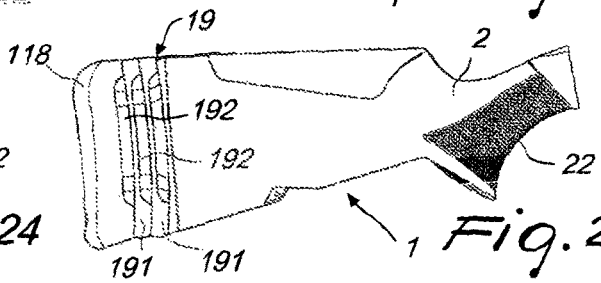
FIG. 25 is a side view of the stock provided with a high buttstock with two pairs of spacers.

FIG. 24 is a view of the use of a standard buttstock 18 with two pairs of spacers 191, 192, while FIG. 25 shows the use of an enlarged or high buttstock 118 with two pairs of spacers 191, 192.

The spacers 191, 192 have been designed to work in pairs, compatibly with the recoil damping system described in EP2711660B1: the fixed spacer 191 remains integral with the stock of the rifle, while the movable spacer 192 can move during firing and ensures the free sliding of the entire damping system with respect to the stock.

Figure 16:
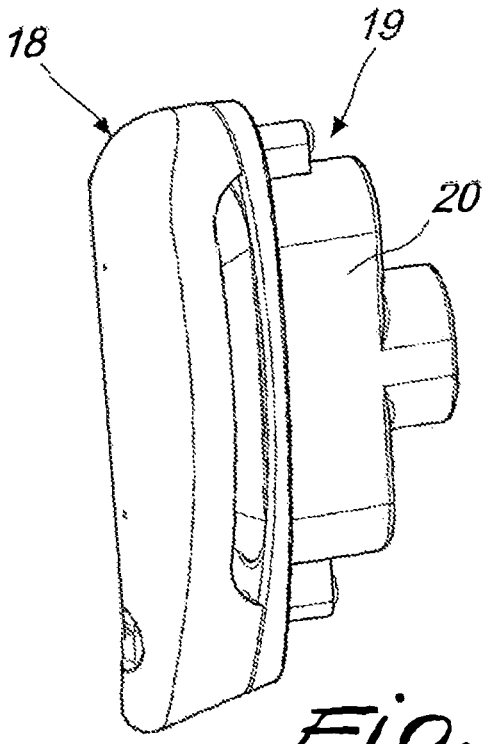
FIG. 16 is a perspective view of the buttstock and of the buttstock support.
Figure 17:
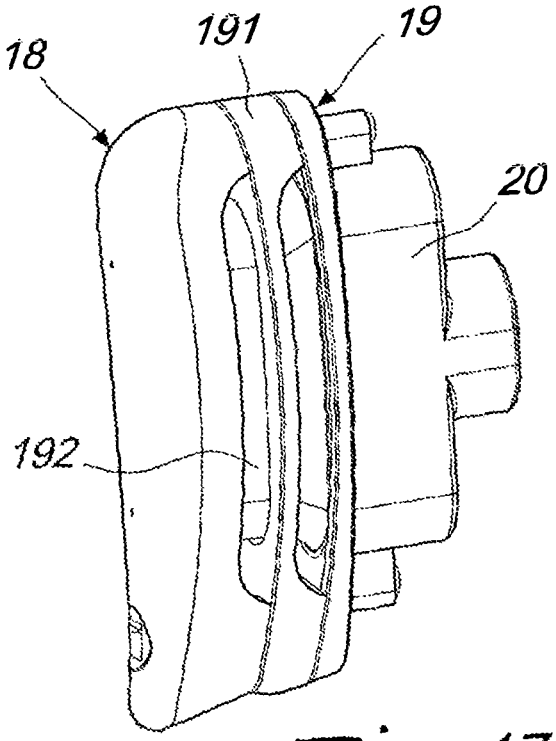
FIG. 17 is a perspective view of the buttstock assembled with a pair of spacers.
Figure 18:
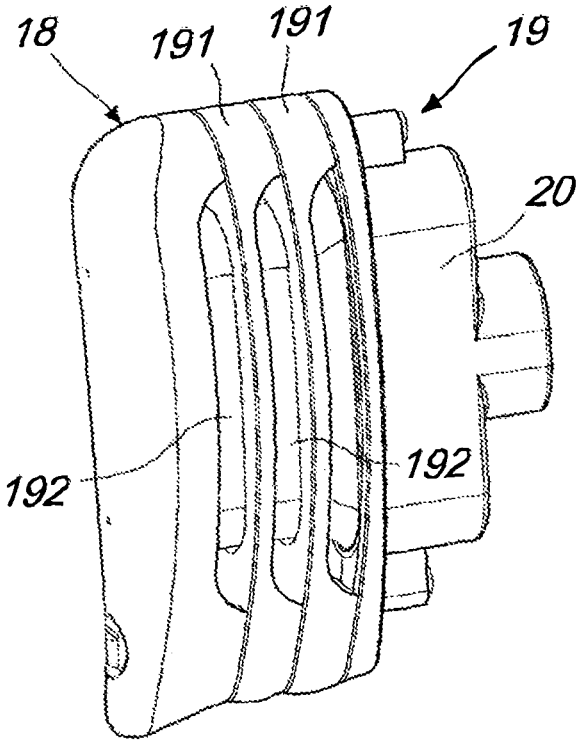
FIG. 18 is a perspective view of the buttstock assembled with two pairs of spacers.
Figure 19:
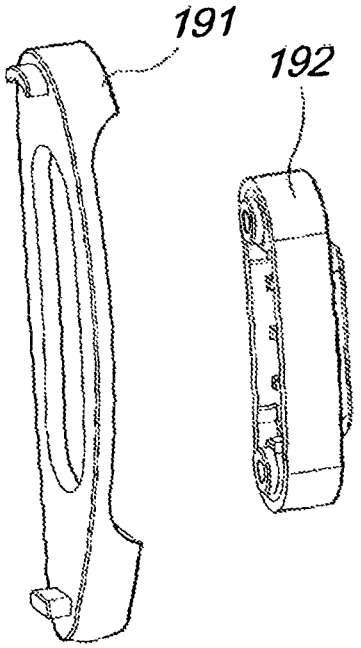
FIG. 19 is a perspective view of a pair of spacers, a fixed one and a movable one.

FIG. 16 is a view of a standard buttstock 18 applied to the support 19 without the use of spacers; FIGS. 17 and 18 show respectively the use of one pair of spacers and of two pairs of spacers.

FIGS. 20-25 show some embodiments combining spacers and buttstocks.

The stock according to the present invention also has a system for varying the height of the comb.

Advantageously, the stock has an interchangeable comb which has a main body and a comb that is detachably associated with the body and has a supporting structure and a cheek-resting pad which rests on an elastic member associated with the structure.

The elastic member is constituted by a leaf spring which is associated with the structure and is easily interchangeable.

The comb is applied to the body of the stock by means of a quick coupling, with or without the use of tools.

Advantageously, the interchangeable comb is of the type described in European patent EP3214400B1.

The quick coupling system allows to easily replace the comb with one that has a different height.

FIGS. 26-30 show some embodiments of stock with combs of different height.

Figure 26:
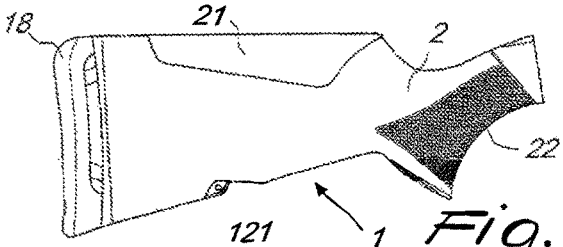
FIGS. 26-28 are side views of the stock in the embodiment made of polymeric material provided with combs of different sizes.
Figure 27:
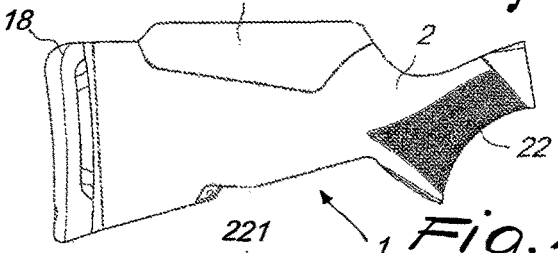
Figure 28:
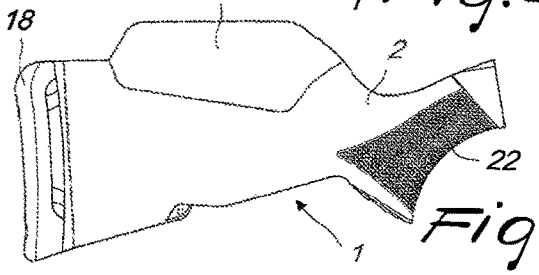

FIGS. 26, 27 and 28 are views of the stock 1, made of polymeric material, provided with combs of different height, designated respectively by the reference numerals 21, 121, 221.

Figure 29:
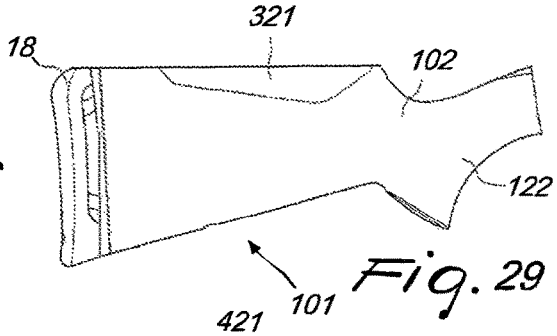
FIGS. 29-30 are side views of the stock in the embodiment made of wood, provided with lugs of different dimensions.
Figure 30:
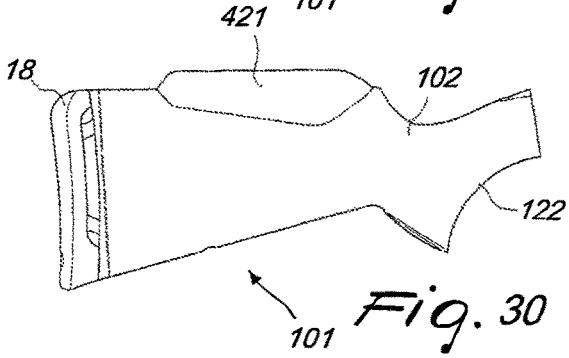

FIGS. 29 and 30 are views of the wood stock 101 provided with the combs of different height, designated respectively by the reference numerals 321 and 421.

The stock according to the present invention also has a system for adjusting the length of pull of the trigger, i.e., the distance between the grip 22, 122 and the trigger of the firearm, which is not visible in the figures.

The pull adjustment system has a number of adjustment plates 23 which can be inserted between the head of the hollow body 2, 102 and the front plate 13.

The user can choose, on the basis of the dimensions of his hand, the number and/or thickness of the plates 23 to be fitted.

The stock according to the present invention also has a system for adjusting the shape of the grip.

The grip adjustment system allows to modify both the ergonomics of the grip, by varying its dimensions, and its tactile perception, by varying the material and/or finish of the grip.

According to the present invention, the grip adjustment system has a number of inserts 24 that can be removed and easily replaced.

In the embodiment shown in FIGS. 35-48, a removable insert 24 is constituted by a contoured body that can be engaged with a contoured portion 222 of the grip 22.

Advantageously, the removable insert has hook-shaped edges 241 which are adapted to engage respective ribs 223 formed at the borders of the contoured portion 222 of the grip 22.

The removable insert 24 is made of various materials, with various finishes and external dimensions, so as to offer the user the possibility to vary the dimensions and tactile perception of the grip according to tastes and requirements.

In practice it has been found that the invention achieves the intended aim and objects, providing a gun stock that has an integrated mechanism for adjusting the drop and/or cast of the stock.

The adjustment system constitutes an innovative solution that has a significantly lower industrial cost than the systems used so far in order to obtain comparable results.

Another advantage of the stock according to the present invention is constituted by the presence of integrated systems that allow to adjust the LOP (length of pull), i.e., the distance between the buttstock and the trigger, to adjust the height of the lug, to adjust the length of pull of the trigger, i.e., the distance between the grip and the trigger, and to adjust the shape of the grip.

The materials used, as well as the dimensions, may of course be any according to the requirements and the state of the art.

This application claims the priority of Italian Patent Application No. 102019000007998, filed on Jun. 4, 2019, the subject matter of which is incorporated herein by reference.

The invention claimed is:

1. A gun stock comprising a hollow body which comprises at least one cavity; a seat formed in said cavity and adapted to receive an insert; said insert comprising a passage hole for the passage of a bar; said bar having a first end and a second end; said first end being fastened to the body of said gun; said free end being threaded and engaging a locking nut; said stock further comprising a fastener plate arranged between said locking nut and said insert; said fastener plate having a calibrated hole; said free end of said bar passing through said calibrated hole; said fastener plate being arrangeable in different positions with respect to said insert in order to change the inclination of said stock with respect to the line of sight of the gun.

2. The stock according to claim 1, wherein said fastener plate and said insert comprise a means for locking said fastener plate on said insert in different discrete positions.

3. The stock according to claim 1, wherein said fastener plate has side teeth; said teeth engaging a pair of toothed abutments formed on said insert; said fastener plate being arrangeable in positions at different heights with respect to said insert.

4. The stock according to claim 1, wherein said fastener plate has said calibrated hole in a central position.

5. The stock according to claim 1, wherein said fastener plate has said calibrated hole in an axially offset position.

6. The stock according to claim 1, wherein said fastener plate has indicator symbols that allow to align the plate with respect to an indicator engraved on said abutments of said insert.

7. The stock according to claim 1, comprising a buttstock, said gun comprising a trigger; said stock comprising a system for adjusting the distance between said buttstock and said trigger.

8. The stock according to claim 7, wherein said system for adjusting the distance between said buttstock and said trigger comprises a buttstock having a variable thickness and/or a buttstock support having a variable thickness.

9. The stock according to claim 8, wherein said buttstock support comprises a recoil reducer device comprising a box-like body in which a damping means is inserted; said damping means comprising a fixed part and a movable part; said fixed part being integral with said box-like body; said movable part being able to slide in an axial direction inside said box-like body; said buttstock being integral with said movable part; said buttstock being provided in various thicknesses; said buttstock support comprising at least one pair of spacers, a fixed spacer and a movable spacer; said fixed spacer being integral with said fixed part of the support; said movable spacer being integral with said movable part of the support.

10. The stock according to claim 1, comprising a comb; said stock comprising a system for varying the height of said comb.

11. The stock according to claim 10, wherein said system for varying the height of said comb comprises a plurality of combs of different height which can be associated with said stock by means of a quick coupling.

12. The stock according to claim 1, comprising a grip; said gun comprising a trigger; said stock comprising a system for adjusting the pull, i.e., the distance between said grip and said trigger.

13. The stock according to claim 12, wherein said pull adjustment system comprises a number of adjustment plates that can be inserted between said hollow body and said front plate.

14. The stock according to claim 1, comprising a grip; said stock comprising a system for adjusting the shape of said grip.

15. The stock according to claim 14, wherein said grip adjustment system comprises a number of removable inserts; each of said removable inserts being constituted by a contoured body that can be engaged with a contoured portion of said grip.

* * * * *